United States Patent [19]
Gibbons
[11] 4,348,805
[45] Sep. 14, 1982

[54] METHOD FOR THE PRODUCTION OF WIRING LOOMS

[75] Inventor: Ralph D. Gibbons, Basingstoke, England

[73] Assignee: Lansing Bagnall Limited, Hampshire, England

[21] Appl. No.: 48,582

[22] Filed: Jun. 13, 1979

[30] Foreign Application Priority Data

Jun. 15, 1978 [GB] United Kingdom ..... 27015/78

[51] Int. Cl.[3] ..... H01R 43/00

[52] U.S. Cl. ..... 29/857; 29/872; 29/863; 140/92.1; 140/93 R

[58] Field of Search ..... 29/749, 753, 751, 423, 29/861, 862, 863, 566, 755, 868, 872, 857; 140/93 R, 92.1, 71 R

[56] References Cited

U.S. PATENT DOCUMENTS

| | | | |
|---|---|---|---|
| 3,186,077 | 6/1965 | Vickery, Jr. . | |
| 3,435,858 | 4/1969 | Taysom et al. | 140/93 R X |
| 3,550,236 | 12/1970 | Lienert | 140/92.1 X |
| 3,612,369 | 10/1971 | Grebe . | |
| 3,699,630 | 10/1972 | Tarbox | 29/755 X |
| 3,842,496 | 10/1974 | Mercer | 29/755 X |
| 3,961,703 | 6/1976 | McKeever . | |
| 4,024,630 | 5/1977 | Wahren et al. . | |
| 4,030,527 | 6/1977 | Roch | 29/755 X |
| 4,126,935 | 11/1978 | Rhines et al. | 29/749 X |

FOREIGN PATENT DOCUMENTS

| | | |
|---|---|---|
| 1299336 | 7/1969 | Fed. Rep. of Germany . |
| 2069415 | 3/1971 | France . |
| 1191338 | 5/1970 | United Kingdom . |
| 1221641 | 2/1971 | United Kingdom . |
| 1224949 | 3/1971 | United Kingdom . |
| 1347281 | 2/1974 | United Kingdom . |
| 1369798 | 10/1974 | United Kingdom . |
| 1388452 | 3/1975 | United Kingdom . |
| 1403431 | 8/1975 | United Kingdom . |
| 1418780 | 12/1975 | United Kingdom . |
| 1463828 | 2/1977 | United Kingdom . |
| 1468878 | 3/1977 | United Kingdom . |
| 1493532 | 11/1977 | United Kingdom . |
| 2021989 | 12/1979 | United Kingdom . |

*Primary Examiner*—Francis S. Husar
*Assistant Examiner*—Carl J. Arbes
*Attorney, Agent, or Firm*—Cushman, Darby & Cushman

[57] ABSTRACT

In the method, lengths of wire are drawn from wire supplies and cut, each end of each cut wire being stripped of insulation and terminated, and the cut wire then being laid along a predetermined path defined by guide pins on a loom board. The wire lengths are then bound together and removed from the board. The wire is handled by a mechanical gripper which moves and is actuated under preprogrammed electronic control.

The apparatus comprises a loom board or the means by which such a loom board can be made, an automatic manipulator having a controlled gripper to draw wire from a preselected supply, a cutter to cut the wire, a wire stripper and insulative sleeve applicator and a terminal supply and crimper, both accessible to the gripper which can then lay the terminated wire lengths along predetermined paths on the loom board, and a tape binder which binds the laid wires together to form the required wiring loom.

4 Claims, 12 Drawing Figures

METHOD FOR THE PRODUCTION OF WIRING LOOMS

FIELD OF THE INVENTION

This invention relates to a method and apparatus for the production of wiring looms. As used herein, the term Wiring loom means a bundle of individually insulated electrical wires, bound or otherwise held together, to be installed in equipment having spaced electrical components to provide the required electrical connections between such components.

BACKGROUND TO THE INVENTION

A major use of such wiring looms is in the manufacture of powered vehicles such as automobiles, industrial trucks. Whether powered electrically, or by means of internal combustion engine, a large number of electrical components require interconnection, and for this purpose one or more such wiring looms are disposed in appropriate channels or recesses, or are otherwise fixed in the vehicle, and the ends of the wires, appropriately precut to the required length and terminated, are connected to the components. The wires usually have different colour insulation to facilitate the correct connection by the fitter of the wires to the components. The looms commonly include wires of a number of different lengths, arranged with various branches projecting from a main central trunk. The production of such looms involves complex procedure, and involves the use of a loom board comprising a board carrying a multiplicity of pins fixed in and projecting from one side of the board, these pins being arranged to define predetermined guide paths along which the wires are laid prior to being bound together.

SUMMARY OF THE INVENTION

According to the present invention there is provided a method of making a wiring loom as hereinbefore defined using a wire guide assembly having means defining predetermined paths for the wires of the loom, comprising, the steps of drawing and cutting a wire from a wire supply, laying the cut wire along a respective one of said predetermined paths after repeating the aforesaid steps in respect of each wire to assemble a bundle of said wires, each following one of said paths thereon, fastening said wires together while located on said wire guide assembly, and removing the wiring loom constituted by said fastened bundle from said wire guide assembly.

Preferably a terminal fitting is applied to one wire end drawn from said wire before said wire is cut, another terminal fitting then being applied to the end of the wire resulting from said cutting.

In a preferred embodiment, each end of the cut wire is presented first to a first device which strips insulation from a wire portion at that end and then to a second device which applies the terminal fitting. In this embodiment the presentation of the wire ends to the first and second devices and the laying of the cut wire is by means of a mechanical gripper device which moves in accordance with a predetermined programme of commands in permanent form and translated into electrical control signals in electronic control apparatus. The commands may be carried, for example on magnetic or punched tape. A method of making a batch of said wiring looms may comprise the initial step of making the wire guide assembly by causing the gripper device to remove guide pins from a supply thereof and to place them at predetermined positions on a board to project from a substantially flat surface of the board to define the predetermined paths; said initial step being followed by the making of one or more wiring looms by a method as hereinbefore defined.

According to the invention there is also provided apparatus for use in the production of a wiring loom as hereinbefore defined, the apparatus comprising means for defining predetermined paths for the wires of the loom, at least one wire supply means for supplying wire to a wire feed station, means for drawing a length of said wire from said feed station, a wire cutter for then cutting said wire at a position at or adjacent said wire feed station, means for applying terminal fittings to wire ends when presented thereto, means for presenting first one and then the other end of said length of wire to said means for applying, means for then laying the cut wire along a predetermined one of said predetermined paths, means for fastening the wires together while said wires lie in a bundle on said predetermined paths, and means for removing the wire loom constituted by said fastened bundle from said means for defining.

Said means for applying may comprise a first device for stripping insulation from the end portions of wires and a second device for fixing the terminal fittings to the wire ends stripped by said first device, said means for presenting and being arranged to present the wire end first to said first device and then to said second device.

The means for drawing, means for presenting and means for laying may comprise an automatic manipulator, which can read pre-programmed commands to generate electrical control signals, and which includes a gripper which is actuated in accord with said signals.

The means for defining may comprise a board adapted to receive and hold guide pins to project from a substantially flat surface of the board.

Means for supplying said guide pins may be provided, the aforesaid gripper device being also controllable to remove pins from said means for supplying and to place them at predetermined locations on said board to define said predetermined paths.

The board may be arranged to be inverted, a conveyor being arranged to pass beneath the board to receive and convey wiring looms falling thereon from the board, when inverted, from the apparatus.

An embodiment of the invention will now be described by way of example with reference to the accompanying drawings.

DESCRIPTION OF THE PARTICULAR EMBODIMENT

Figure 1:
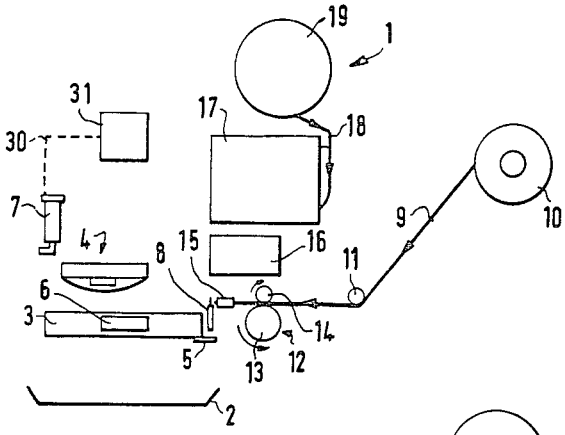
FIG. 1 is a schematic side elevational illustration of apparatus for use in the production of wire looms.

With reference to FIG. 1, apparatus 1 for the production of wire looms is located generally above a conveyor 2 which conveys the completed looms away from the apparatus. The apparatus comprises a rectangular loom board 3 adapted to receive and hold guide pins to project upwardly from a flat upper surface of the board to define predetermined paths for the wires of the loom.

A guide pin feeder 4 is disposed over the loom board 3 and is adapted to present the pins *4a* (see FIGS. 2 to 14) to be gripped and removed by means of a mechanical gripper, such as one having a pair of relatively displaceable jaw members and a pneumatic actuator arranged to control the relative movement of the jaw members. The pins so supplied are double-ended to avoid the necessity for the feeder to distinguish between differently shaped pin ends and to select one such end for presentation to the gripper.

The construction of the loom board is such as to permit the pins to be temporarily fixed at any point on the board and to be readily ejected when desired. The board is preferably pivotally mounted so as to be inverted, thereby to facilitate removal of wiring looms therefrom, and deposition of the looms upon the conveyor. A stop 5 and indexing unit 6 serve to locate the loom board properly with respect to the other components of the apparatus.

The gripper 7 is part of an automatic manipulator, and is carried at the end of an articulated arm, indicated schematically, at 30 by a broken line. The movements of the arm and actuation of the gripper 7 are under electronic control from a central control unit 31 of the manipulator, the sequence of operational movements being predetermined and preprogrammed in a memory, or upon a suitable recording medium such as punched or magnetic tape, or floppy disc which bears coded commands for conversion into electrical signals which can be processed in the electronic control to actuate the gripper as required. An automatic manipulator which is particularly suitable for this purpose is the "Puma" robot made and sold by Unimation Inc., of Danbury, Connecticut, U.S.A.

Disposed within the range of movement of the gripper is an assembly of electrically operable wire cutters 8, one such cutter being provided for each respective one of a plurality of wires 9. Each wire 9 is supplied from a respective reel 10 and extends via one or more guide pulleys 11 through a wire drive assembly 12 comprising a drive capstan 13 and a pinch roller 14, and through a guide 15 to the respective cutter.

Also accessible to the gripper is an assembly of wire stripper and sleeve dispenser units 16 and wire terminal supply and crimp units 17. Each unit 16 is capable of removing from an end of a wire properly presented thereto by the gripper, a predetermined length of insulation from the conductive core, and of placing over the bared wire an insulating sleeve. Units 17 are each capable of applying to the bared wire and, when properly presented thereto by the gripper, and after stripping and sleeve placement by a unit 16, an appropriate terminal element, such as a spade terminal. The unit 17 crimps the terminal onto bared wire end, and then moves the insulating sleeve over the crimped part of the terminal. The terminals may be supplied to the units 17 from a reel 19 in the form of a continuous strip 18 from which the individual terminals are cut.

The construction and operation of the cutters, stripper and insulator units, and terminal supply and crimp units form no part of the present invention and accordingly has not been described in detail herein.

The sequence of operation of the apparatus of FIG. 1 in the production of a batch of wire looms will now be described.

Figure 2:
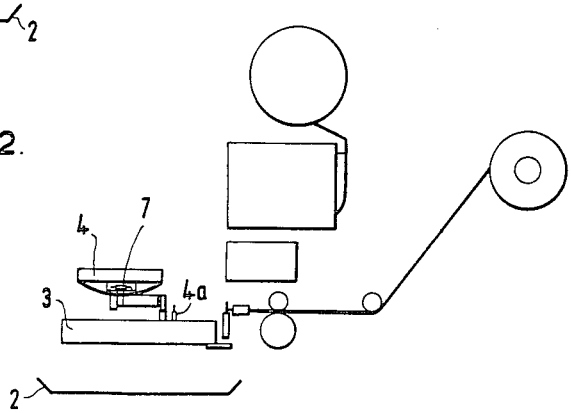
FIGS. 2 to 12 are schematic illustrations showing successive steps in the operation of the apparatus of FIG. 1 to produce a wire loom.

The first part of the sequence is the setting up of the required loom board to define the correct wire paths for the particular type of loom to be produced. To achieve this, the gripper operates under the pre-programmed electronic control to remove pins from the guide pin feeder 4, one at a time, and to place them on the board at predetermined positions, as illustrated in FIG. 2, the board being adapted to receive and releasably hold the pins with a portion of each pin projecting from the board.

As mentioned before, the pins define the paths for the wires of the loom these paths consisting generally of a central trunk path along which a part of most, if not all of the wires, will extend, and a number of branch paths, projecting laterally from the trunk paths, along which the end portions of the wires will extend.

The required wire reels 10 are then loaded on reel stands (not shown) in a manner and sequence as dictated by the programme controlling the electronic control, and the leading ends of the wire fed round the guide pulleys 11, through the wire drive assemblies 12 and guides 15.

Figure 3:
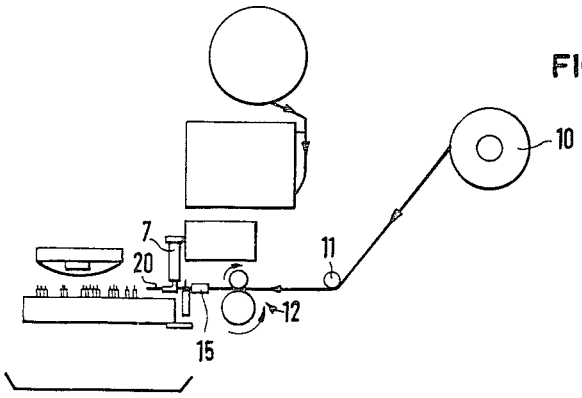
Figure 4:
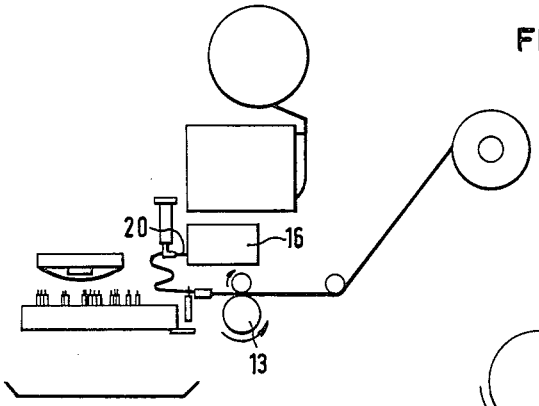
Figure 5:
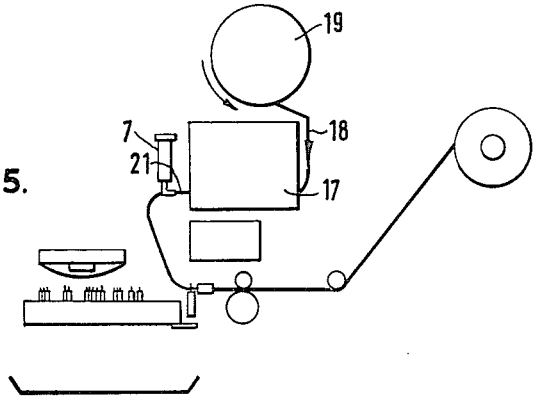
Figure 6:
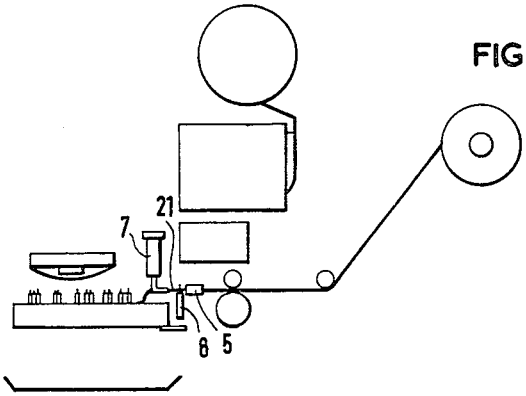
Figure 7:
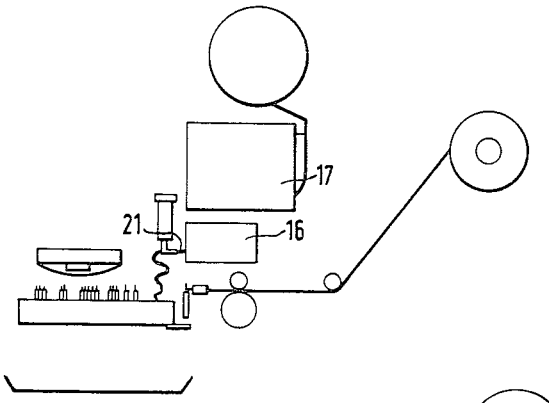
Figure 8:
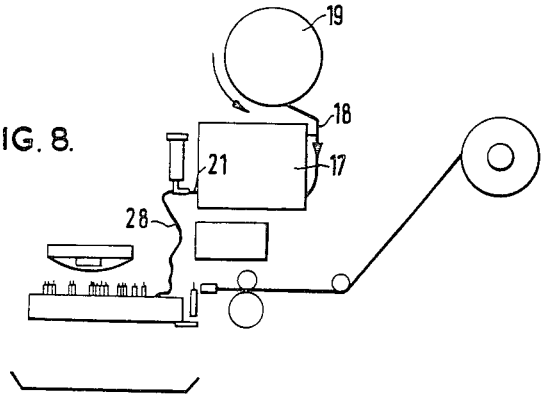

The gripper 7 then grips the wire projecting from a guide 15, leaving a projecting end portion 20, and the drive assembly 12 for that wire is actuated, as shown in FIG. 3. A predetermined length of the wire is advanced by means of the drive capstan 13, and simultaneously the wire end portion 20 is presented to a stripper and sleeve dispenser unit 16, and then to a terminal supply and crimp unit 17, which operate upon the wire end as described hereinbefore. FIGS. 4 and 5 illustrate these two operations. The capstan 13 stops, and the gripper 7 then releases the now terminated wire end, and returns to take hold of the wire adjacent and just beyond the wire cutter 8, relative to the guide 15, as shown in FIG. 6. The cutter 8 is then actuated by a signal from the electronic control, and the end portion 21 now held by the gripper is presented to the stripper and sleeve dispenser unit 16 and to the terminal supply and crimp unit 17, as illustrated in FIGS. 7 and 8.

Figure 9:
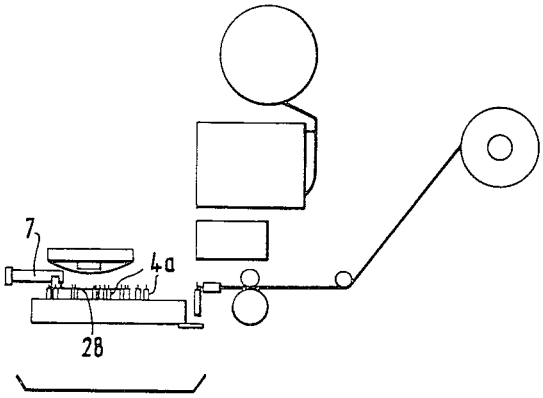

The gripper 7 then lays the cut and terminated length of wire 28 along its predetermined path by anchoring the end just terminated between a pair of pins at that end of the board and threading the wire between the pins *4a* defining that path, as illustrated in FIG. 9.

The above described procedure of wire stripping, terminating, cutting and positioning is repeated for each wire length of the loom, different colour coded wire, wire lengths and terminal types being employed as dictated by the operational programme.

Figure 10:
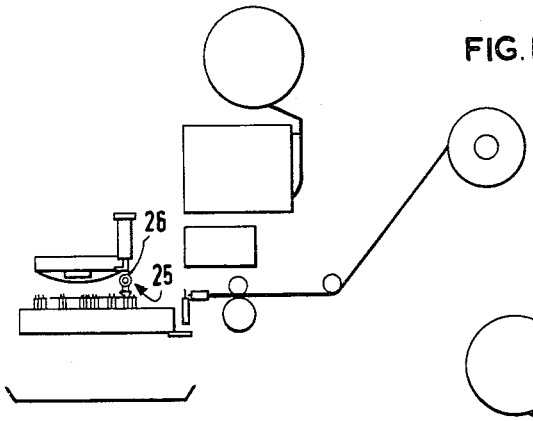

When all of the wire lengths have been laid on the loom board, an adhesive tape dispenser 25 operates to apply, at each of a number of specific points on the main trunk and branches of the loom, a length of tape drawn from a reel 26 to encircle and bind together the wire, as illustrated in FIG. 10.

Figure 11:
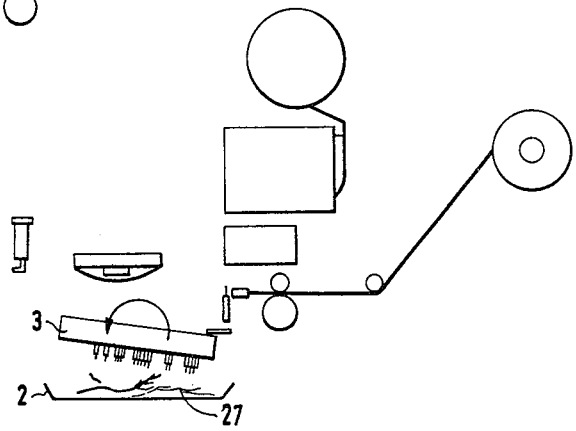

The loom board 3 is then inverted, as shown in FIG. 11 to drop the bound loom 27 onto the conveyor 2 which may convey the loom to a braiding machine (not shown) which applies a protective braiding to the entire loom.

Figure 12:
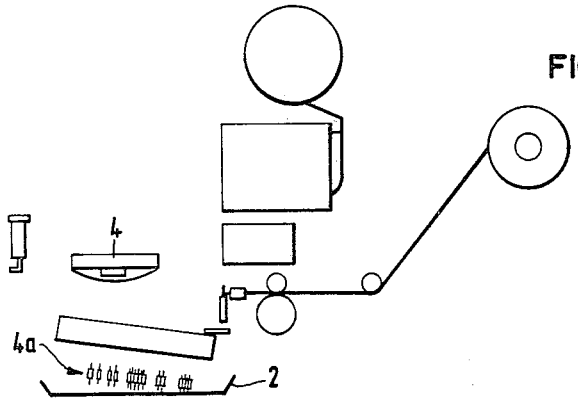

After ejecting any loom which is not to be the last of the batch, the board is reinverted so that the pins again project upwardly, and another similar loom of wires is assembled on the board, bound and ejected. After ejecting the last loom of the batch, the pins *4a* are released from the board and jettisoned, as shown in FIG. 12, while the board is still inverted and consequently fall onto the conveyor 2 whence they may be collected and returned to the guide pin feeder 4. The loom board, after reinversion, is then ready to receive guide pins defining the wire paths of a different loom batch to be produced subsequently.

I claim:

1. A method of providing wires for making a wiring loom, using a loom board adapted to receive releasable guide pins such that said guide pins protrude from a surface of said loom board, and an automatic manipulator means which moves and is actuated in accordance with pre-programmed stored commands, the method comprising the steps of:

(i) causing said manipulator means to remove said guide pins from a supply thereof and to place said guide pins at predetermined positions on said loom board so that said guide pins project from said loom board surface and define a plurality of predetermined paths for wires of said loom, each of said paths extending between said guide pins defining the respective path;

(ii) presenting a plurality of wires from supplies thereof;

(iii) causing said manipulator means to grip a selected wire;

(iv) feeding a predetermined length of the selected wire to the said manipulator means;

(v) cutting the wire to sever the length thereof;

(vi) causing the said manipulator means to anchor the length of wire at one end thereof and to lay said length along a respective one of said predetermined paths;

(vii) repeating the steps (iii) to (vi) so that a length of a respectively selected wire is laid along each of said predetermined paths;

(viii) fastening the lengths of wire together while they are located along said predetermined paths, so as to form a bundle of wires constituting the required wiring loom; and (ix) removing said bundle of wires from said loom board.

2. A method according to claim 1, wherein the step of removing said bundle of wires from the board comprises passing a conveyor beneath said board and inverting said board so as to cause said bundle of wires to fall therefrom onto the conveyor.

3. A method of making a wiring loom, using a loom board adapted to receive releasable guide pins such that said guide pins protrude from a surface of said loom board, and an automatic manipulator means which moves and is actuated in accordance with pre-programmed stored commands, the method comprising the steps of:

(i) causing said manipulator means to remove said guide pins from a supply thereof and to place said guide pins at predetermined positions on said loom board so that said guide pins protrude from the surface and define a plurality of predetermined paths for wires of said loom;

(ii) presenting the ends of a plurality of wires from supplies thereof;

(iii) causing said manipulator means to grip the presented end of a selected wire;

(iv) cutting the wire and feeding a predetermined length of the selected wire to said manipulator means;

(v) causing said manipulator means to present a first end and then a second end of said length of wire for the fitment of a terminal;

(vi) concurrently with step (v), fitting a terminal to each end of said length of wire;

(vii) causing said manipulator means to anchor said length of wire at one end thereof and to lay said length along a respective one of said predetermined paths;

(viii) repeating steps (iii) to (vii) so that a respective length of a respectively selected wire is laid along each of said predetermined paths;

(ix) fastening said lengths of wire together while they are located along said predetermined paths, so as to form a bundle of wires constituting the required wiring loom; and (x) removing the said bundle of wires from said board.

4. A method of making a wiring loom, using a loom board adapted to receive releasable guide pins such that said guide pins protrude from a surface of said loom board, and an automatic manipulator means which moves and is actuated in accordance with pre-programmed stored commands, the method comprising the steps of:

(i) causing said manipulator means to remove said guide pins from a supply thereof and to place said guide pins at predetermined positions on the board so that said guide pins project from said surface and define a plurality of predetermined paths for wires of said loom, each of said paths extending between pins defining the respective path;

(ii) presenting a plurality of wires from supplies thereof;

(iii) causing said manipulator means to grip a selected wire;

(iv) advancing a predetermined length of said selected wire to said manipulator means;

(v) causing said manipulator means to present said end of said selected wire for the fitment of a terminal;

(vi) causing said manipulator means to release said first end and to grip the length of said selected wire at a predetermined position;

(vii) cutting said selected wire to form a second end of said length of wire;

(viii) causing said manipulator means to present said second end of said length of wire for the fitment of a terminal;

(ix) causing said manipulator means to lay said length of wire along a respective one of said predetermined paths;

(x) repeating the steps (iii) to (x) so that a multiplicity of lengths of wire are laid, each length extending along a respective predetermined path;

(xi) fastening said lengths of wire together while they are located along said predetermined paths to form thereby a bundle constituting said wiring loom; and (xii) removing said bundle from said board.

* * * * *